US007572034B2

(12) United States Patent
Bansbach

(10) Patent No.: US 7,572,034 B2
(45) Date of Patent: Aug. 11, 2009

(54) MULTIPLE SIDE ILLUMINATION ASSEMBLY

(75) Inventor: Udo Bansbach, Berlin (DE)

(73) Assignee: Semperlux Aktiengesellschaft, Berlin (DE)

( * ) Notice: Subject to any disclaimer, the term of this patent is extended or adjusted under 35 U.S.C. 154(b) by 0 days.

(21) Appl. No.: 11/789,171

(22) Filed: Apr. 23, 2007

(65) Prior Publication Data

US 2007/0247845 A1 Oct. 25, 2007

(30) Foreign Application Priority Data

Apr. 21, 2006 (DE) ..... 10 2006 019 194

(51) Int. Cl.
*F21V 5/04* (2006.01)

(52) U.S. Cl. ..... 362/309; 362/326; 362/337; 362/308; 362/310

(58) Field of Classification Search ..... 362/326, 362/337, 260, 287, 278, 298–302, 308–311
See application file for complete search history.

(56) References Cited

U.S. PATENT DOCUMENTS 4,943,900 A 7/1990 Gartner
6,129,447 A * 10/2000 Futami ..... 362/522
6,749,313 B2 * 6/2004 Ludwig et al. ..... 362/620
6,851,833 B1 * 2/2005 Simon ..... 362/268
2004/0195947 A1 10/2004 Clark et al.
2007/0247845 A1 * 10/2007 Bansbach ..... 362/235

FOREIGN PATENT DOCUMENTS

DE 10011257 A1 3/2001
GB 713115 8/1954

* cited by examiner

*Primary Examiner*—Anabel M Ton
(74) *Attorney, Agent, or Firm*—Thorpe North & Western LLP

(57) ABSTRACT

The invention relates to a lighting assembly (10) comprising a housing (12), with one or more openings (26, 28, 30). A lighting means (40) is arranged in this housing emitting radiation through the openings (26, 28, 30) in angular ranges. Means (72) for shielding said radiation from a distant observer are provided. The invention comprises a first transparent cover (32; 72) for covering the openings of the housing. The cover has a micro structure profile (102) to shield unwanted radiation from selected portions of the angular ranges. A second transparent cover (70) protects the micro structure profile of the first cover.

14 Claims, 20 Drawing Sheets

MULTIPLE SIDE ILLUMINATION ASSEMBLY

TECHNICAL FIELD

The invention relates to a lighting assembly with a housing, a lighting means arranged in the housing, the radiation of the lighting means emitted through one or more openings in the housing and means for shielding this radiation, wherein at least one opening of the housing is disposed on the side.

PRIOR ART

Lighting assemblies for interiors are usually integrated into the wall or ceiling, provided thereon, or suspended from the ceiling in the form of suspended luminaires. The suspended luminaires mostly have a cuboid housing which is downwardly open. The suspension means are fixed to the upper side or to the ends of the housing.

In known suspended luminaires the light is emitted from the housing through the downwardly directed opening. In order to avoid the direct insight into the lighting means and the blinding caused thereby, the opening is provided with lamellae.

Furthermore, sheets are known which are provided with micro prisms on the surface. The light is deflected at such micro prisms. If such a micro prism plate is used in the emission opening of a lighting housing, blinding of the viewer is avoided. However, it is a disadvantage of such sheets that they are easily contaminated and collect dust. Dirt and finger prints are constantly visible on the surface for a long time. Further, the handling of the sharp-edged sheets can cause injuries.

SUMMARY OF THE INVENTION

It is an object of the invention to provide a lighting assembly of the above mentioned kind with improved lighting behavior and which is easier to handle.

According to the invention this object is achieved in that the housing is closed with a transparent cover having a micro structure profile on its outside, the micro structure being provided with a flat transparent cover, wherein the micro structure is adapted to shield radiation. In particular the micro structure can be shaped in such a way that the angular range visible for people is shielded.

In such an assembly, the radiation is not only downwardly emitted but in any desired angular range. The blinding effect caused thereby is avoided by the use of a cover having a micro structure. In order to avoid contamination and facilitate the handling of the cover, a further flat cover is provided on the profile. This further cover can be easily cleaned and is not contaminated as easily. Furthermore, it can be handled without risking injuries.

The openings of the housing may extend along the main portion of the side areas and downwards and the covers are held in one or more frame portions. Due to the use of the profiled covers there will be no blinding, even with very large light emitting openings.

The housing can have a rectangular cross section, the two sides and the bottom section forming openings of the housing which are covered by flat sheets with a profiled surface. Alternatively, the housing can have a polygonal, oval, or circular cross section or any other organic cross section.

Furthermore, it is possible to provide shapes with a cross section varying along the length of the housing. For example, the housing can narrow towards the ends, the housing may be arc shaped or have steps.

Preferably the covers are made of pressed acrylic or glass. Alternatively the cover my be of rolled material or foils. The profile can be produced with the highest precision from pressed acrylic. The covers may also consist of a fire-resistant plastic material, especially polycarbonate.

The micro structures are microprisms, especially outwardly projecting micro prisms. A micro prism has outer diameters in the range of some tenths of millimeters. Alternatively, pressed linear or crossed structures are possible also. Preferably the opening angle of the prisms or linear lamellae changes along the height of the openings. In this case the radiation emitted in a sideways direction can be directly deflected in a preferred angular range. Other angular ranges, however, are illuminated only very little or not at all. In such a way a shielding is effected on one hand and on the other hand an improved illumination is effected in the desired direction.

Preferably the housing comprises two end portions which are connected by frame portions wherein the frame portions are additionally kept in their position by plane support parts positioned parallel to the end portions. The frame portions may be profiled bars having the same cross section along their entire length. This enables a cheap production. The support parts can be inserted into slits or grooves provided in the bars perpendicular to their longitudinal axes. The lighting means, for example a fluorescent lamp, can be shifted through holes in the support parts.

Preferably the end portion is provided with an opening adapted to insert connection elements. The connection elements may be locked or clamped therein. These connection elements can be variably selected. Depending on the use, different connection elements are inserted into the same housing. In such a way a modular system is generated which may be easily adapted to the respective requirements.

In a further modification of the invention the connection elements are pivotably connected to each other and/or are adapted to be connected with fixing devices. In this case several lightings can be connected to each other. The connection angle is variable.

A plurality of lighting means with different wavelength spectra can be provided and control means to adjust the radiation intensity of the individual lighting means can also be provided. A lighting means can have a spectrum with a particularly high intensity in the short wavelength spectral range and a further lighting means can have a spectrum with particularly high intensity in the longer spectral wavelength range. Then, the light can be varied between a cold, more blue spectrum having a correspondingly high radiation temperature and a warm, more red spectrum having a correspondingly low radiation temperature.

Additional features and advantages of the invention will be apparent from the detailed description which follows, taken in conjunction with the accompanying drawings, which together illustrate, by way of example, features of the invention.

DESCRIPTION OF THE ILLUSTRATED EMBODIMENTS

Figure 1:
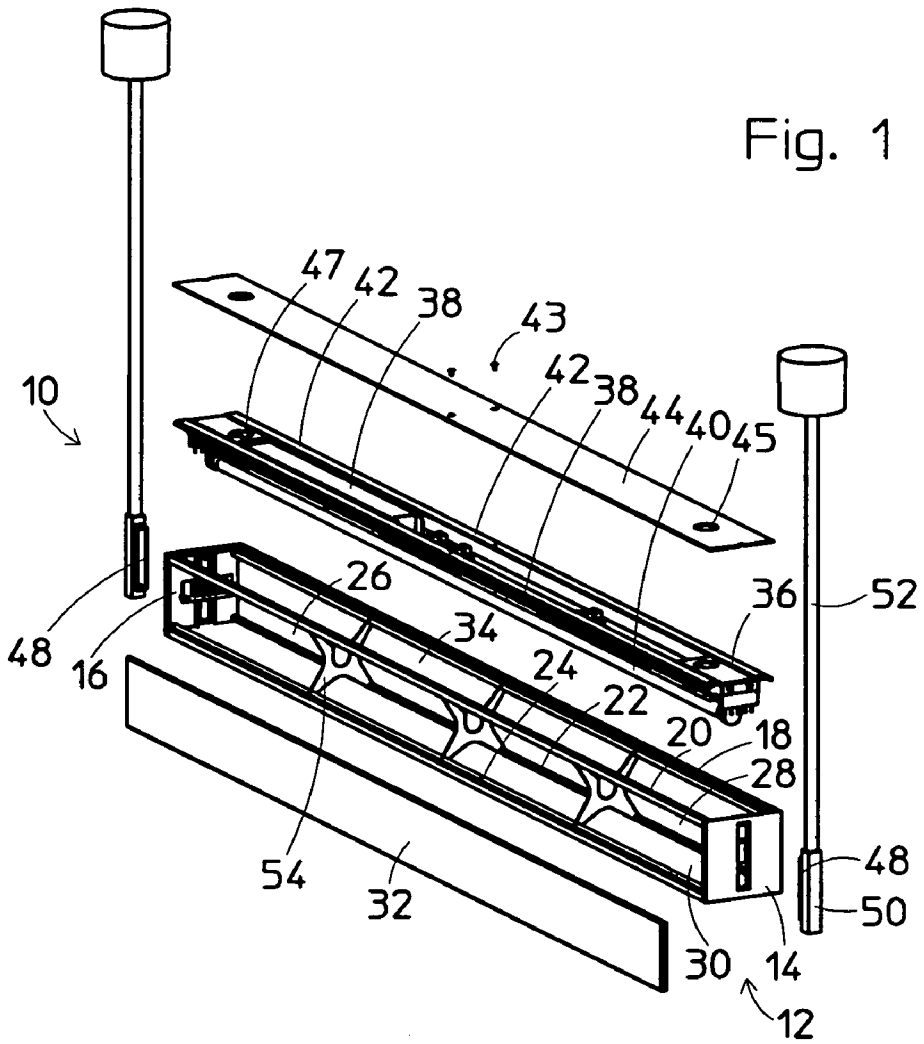
FIG. 1 is an exploded view of a modular lighting assembly.
Figure 2:
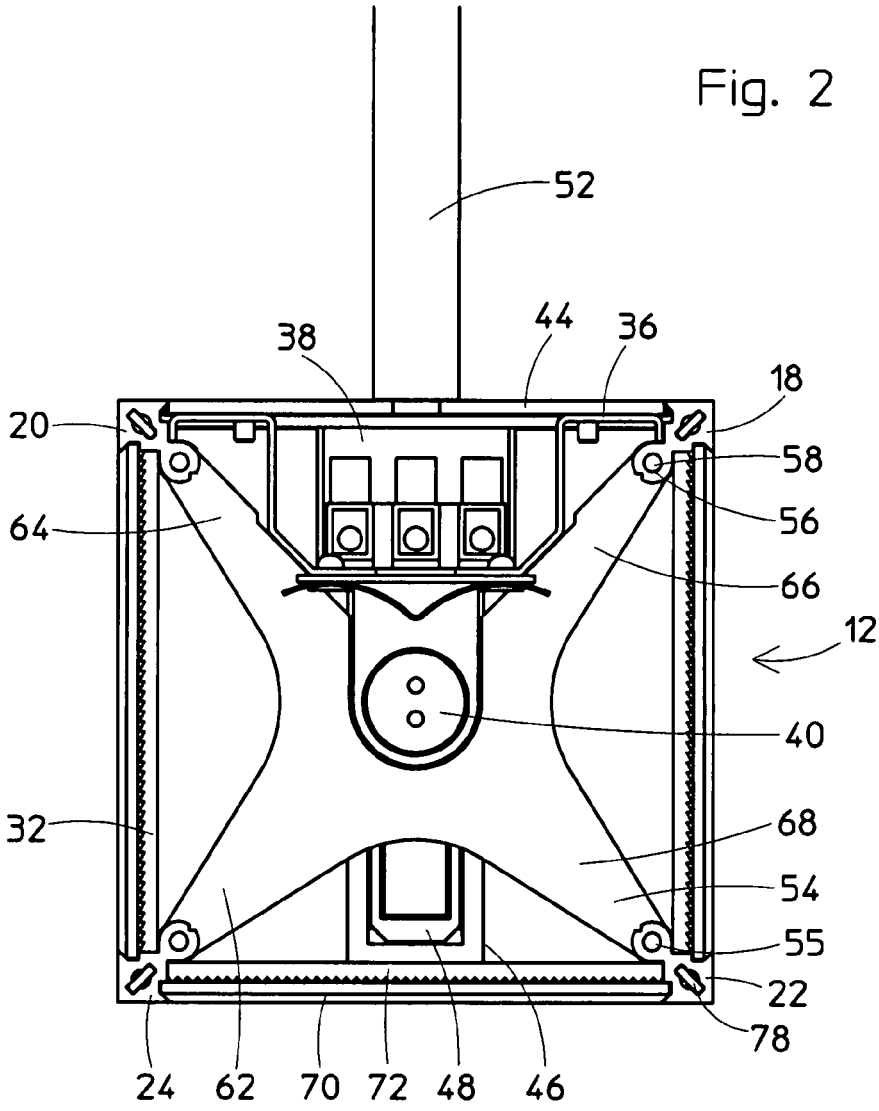
FIG. 2 is a cross sectional view of the lighting assembly of FIG. 1.
Figure 3:
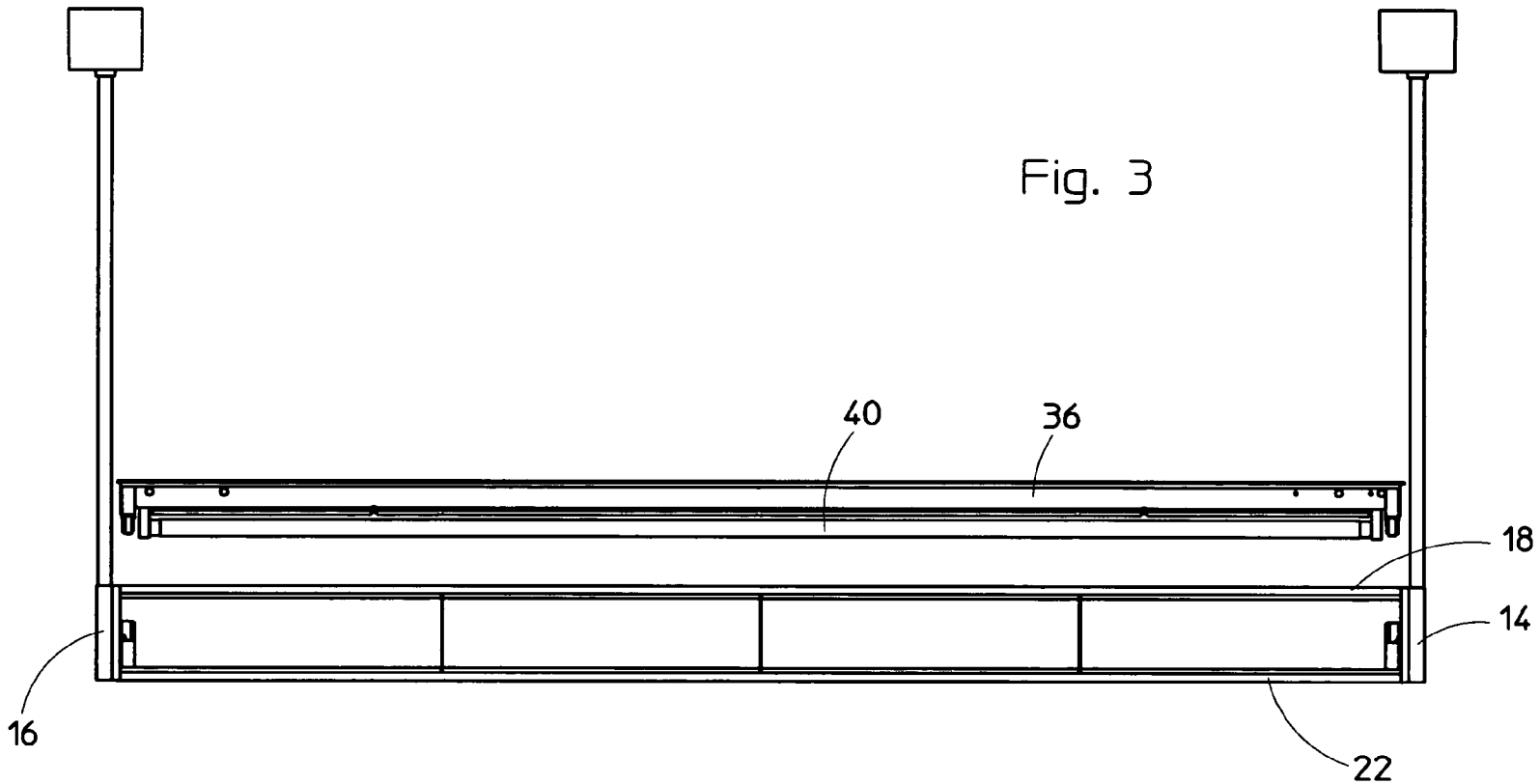
FIG. 3 is a longitudinal view through the lighting assembly of FIG. 1.
Figure 4:
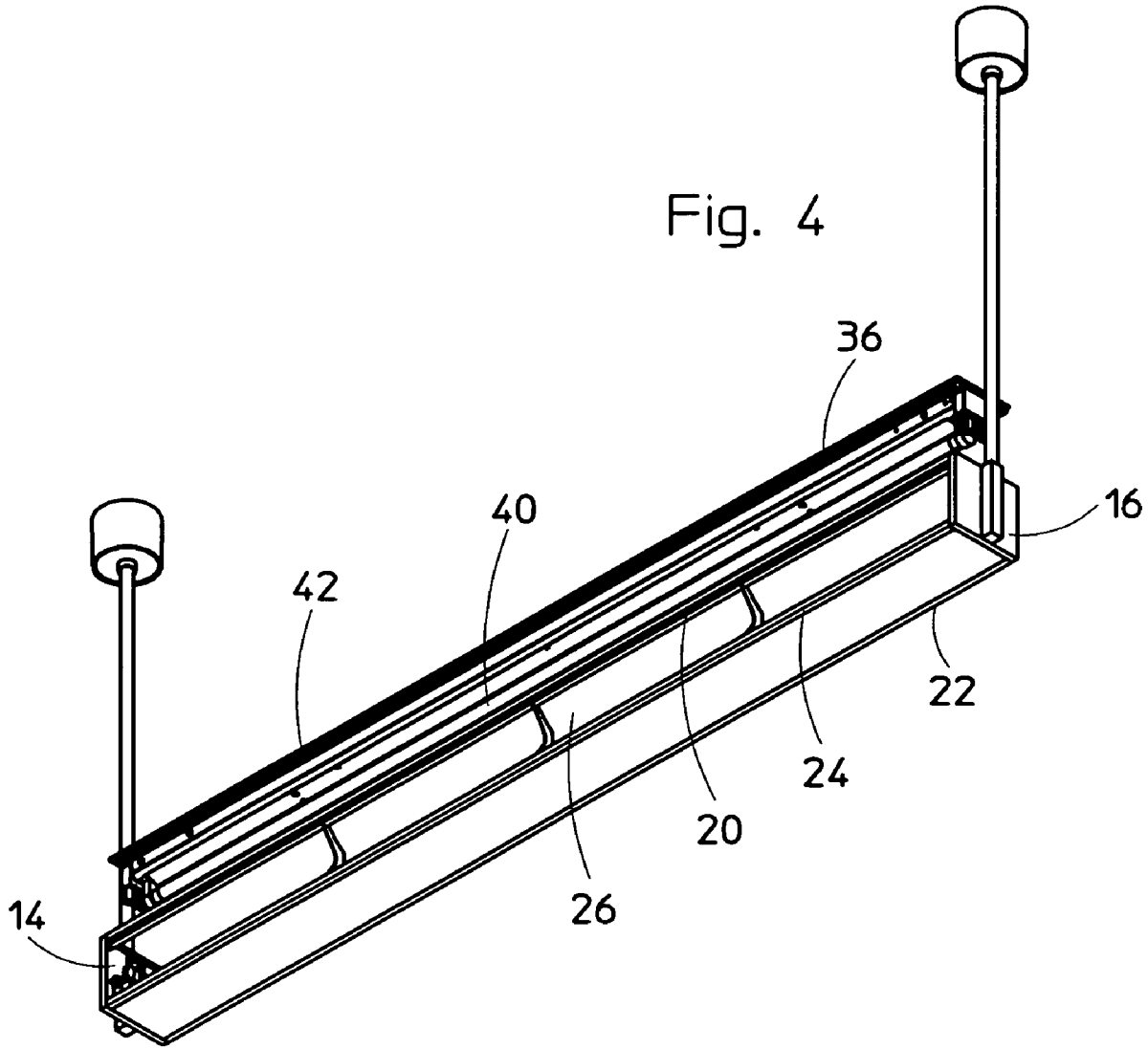
FIG. 4 is a perspective view of the open lighting assembly of FIG. 1.
Figure 5:
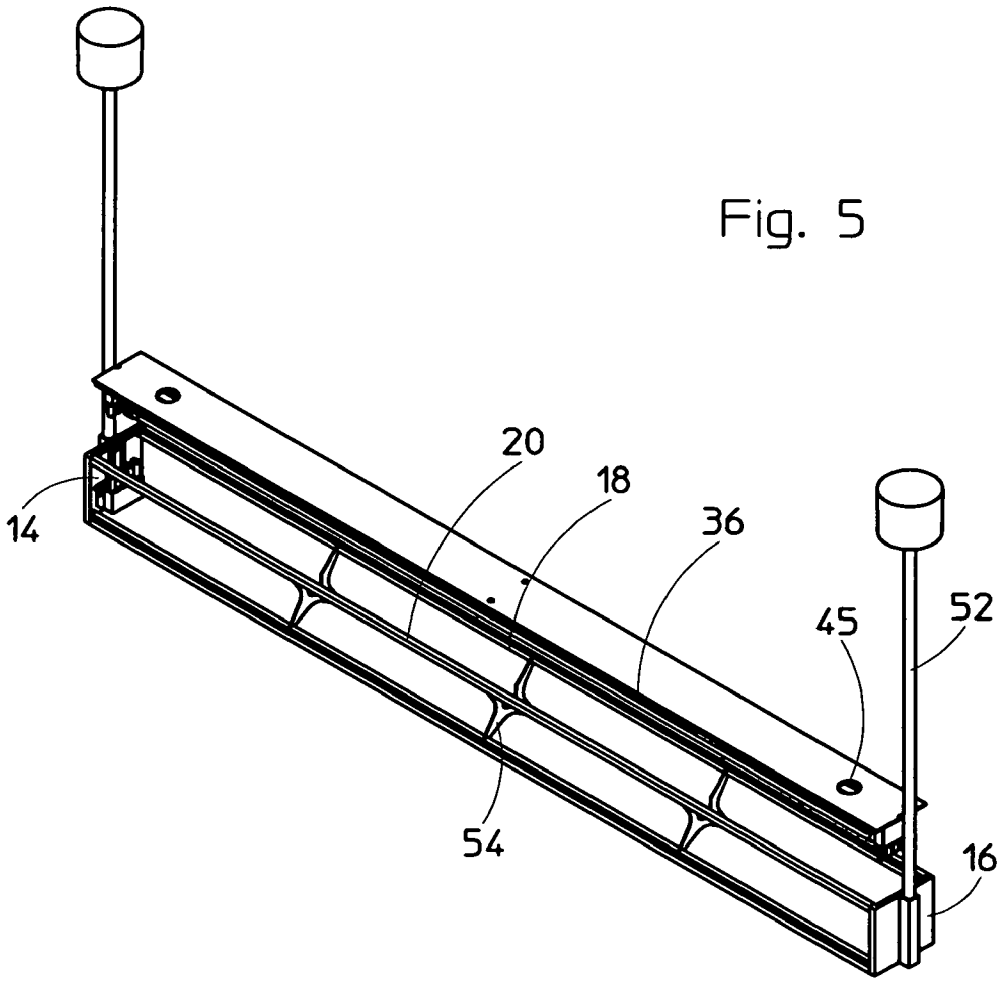
FIG. 5 is a perspective view of the open lighting assembly of FIG. 4 in a different perspective

FIG. 1 shows an exploded view of a modular lighting assembly 10. In FIG. 2 a cross sectional view thereof and in FIG. 3 a longitudinal cross sectional view thereof is shown. FIGS. 4 and 5 show the assembly in an assembled state. The same parts are denoted with the same numerals in all the figures.

The lighting assembly comprises a housing 12. The housing 12 comprises two parallel, plane end portions 14 and 16. The end portions 14 and 16 are square and parallel. Connection bars 18, 20, 22 and 24 are inserted into the corners of the end portions 14 and 16. The connection bars are slightly longer than a fluorescent lamp with standardized size. They connect the end portions 14 and 16.

The lateral openings 26 and 28 formed by the end portions 14 and 16 and the connection bars 18, 20, 22 and 24, and the opening 30 which is downwardly directed are covered by micro prism plates described below in greater detail. Only a lateral micro prism plate 32 is indicated in FIG. 1.

Figure 19:
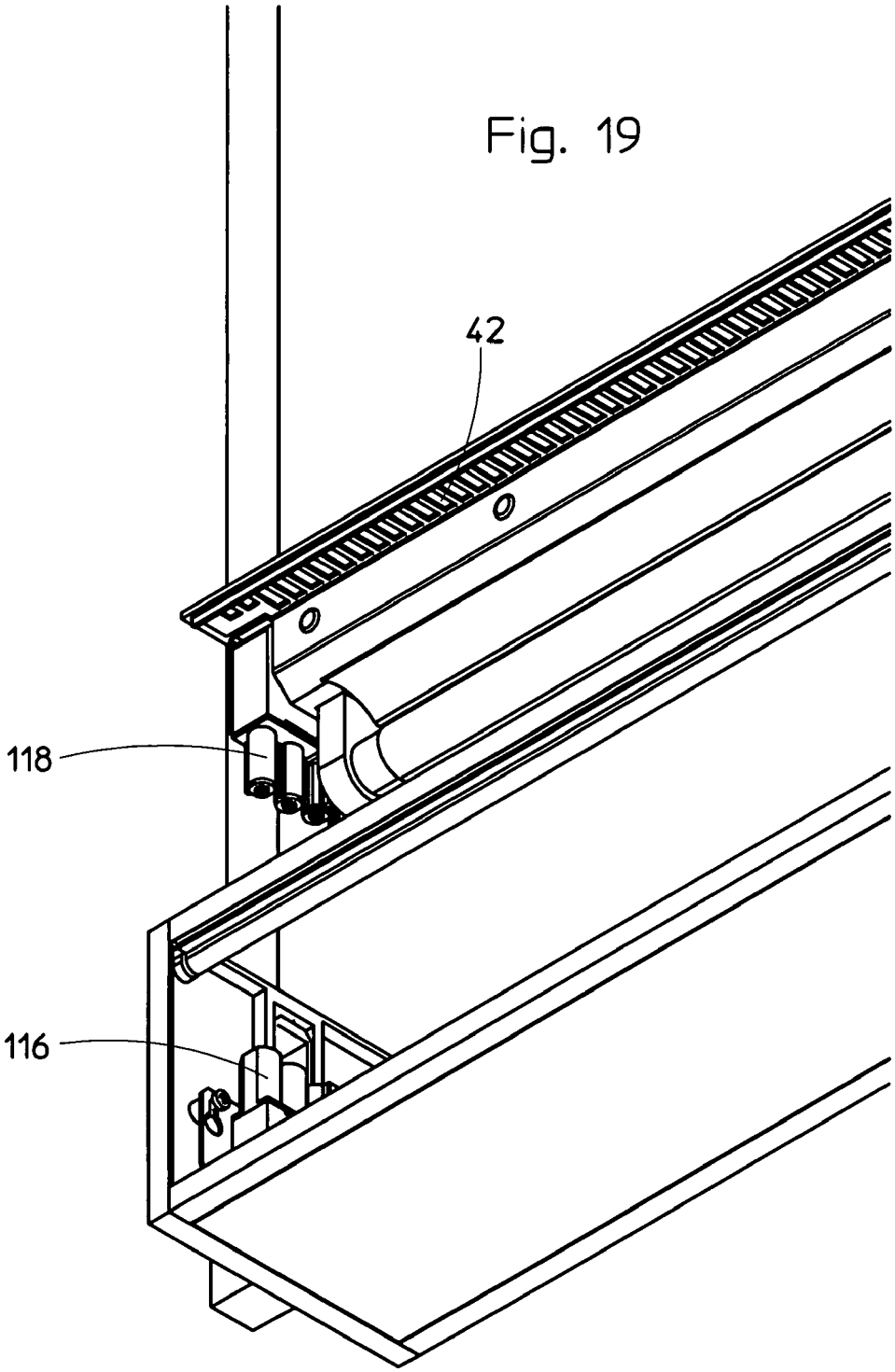
FIG. 19 is a detailed view of the lighting assembly of FIG. 1 with an electric socket connection.
Figure 20:
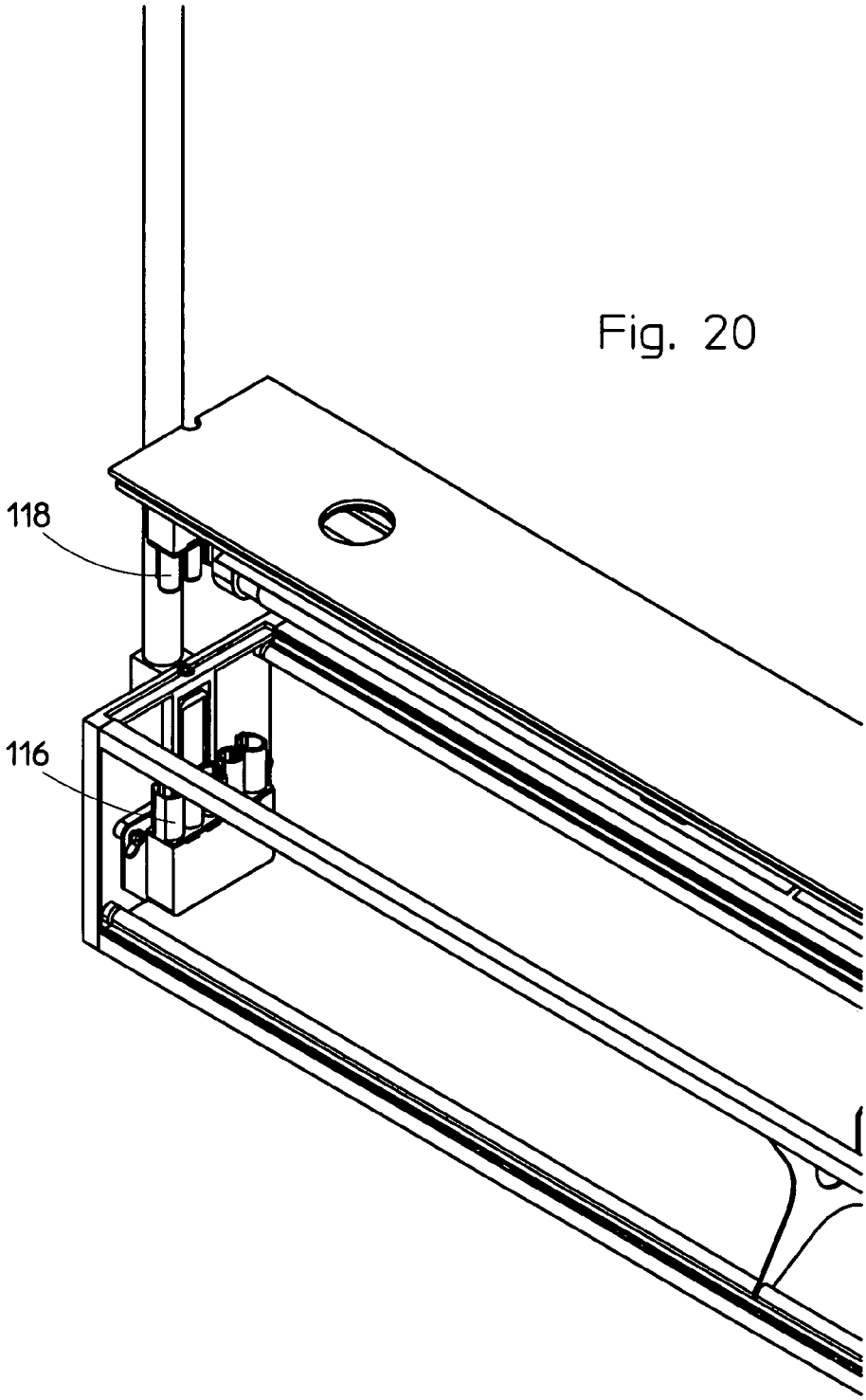
FIG. 20 is a detailed view as in FIG. 19 but from a different perspective.

The upper opening 34 is covered by a metal cover 36. It defines a wide groove along the entire length of the housing to accommodate the control device 38 and the cable connections. A fluorescent light 40 is arranged on the lower side. The cover 36 is provided with a plurality of parallel slits in the lateral areas 42 where light is also emitted (see also FIG. 19). Otherwise the cover is made of opaque material of the remaining housing, for example of chromed metal or the like. The upside of the cover is screwed in the middle to rest of the housing with another, transparent opal cover 44. Screws 43 are provided for this purpose. This allows for an expansion of the cover in both directions upon heating. Service bore holes 45 are provided at the ends of the cover. The service holes 45 facilitate the removing of the cover, for example for servicing. Corresponding holes 47 are provided in the cover 36.

Figure 7:
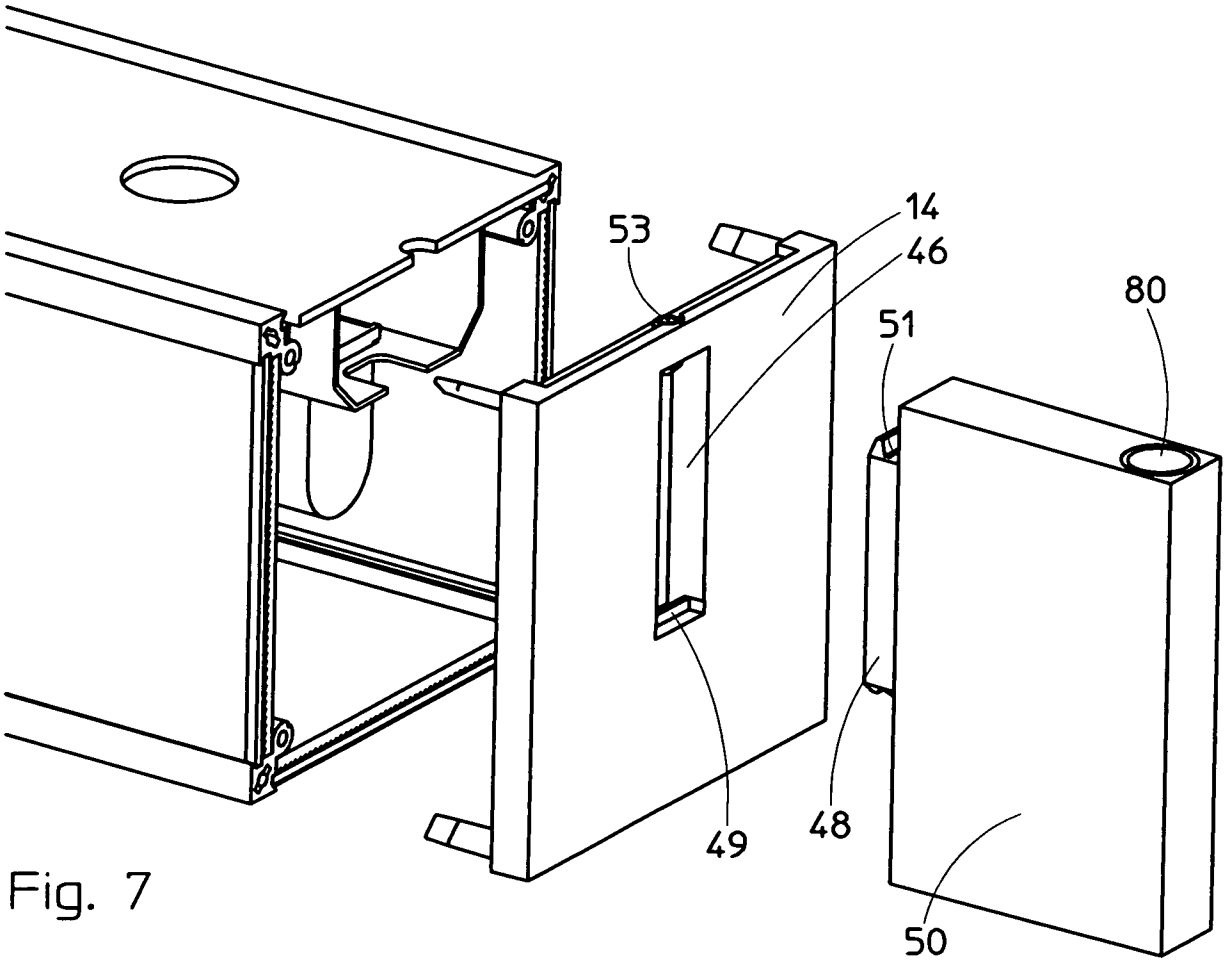
FIG. 7 is a detailed view of FIG. 1 with an end portion and a connection portion.

The end portions 14 and 16 are provided with vertical, rectangular slits 46 (see also FIG. 7). A cuboid projection 48 disposed on a connection element can be inserted into those slits.

The connection element is provided with a vertical bore hole adapted to insert a tube 52. The light is fixed to, for example, a ceiling with this tube 52. Electric cables to supply the lighting means is accommodated in the tube 52.

The slit 46 has a projecting, roof-shaped profile 49 on the inside at the lower edge. The connection element 50 has a corresponding profile 51 which may be recognized in FIG. 8, too. The connection element 50 is inserted into the slit 46 during assembling to form-fittingly engage the profiles. A countersink screw is screwed into the profile 51 (FIGS. 7 and 8) through a corresponding threaded bore 53. In such a way the screw fixes the connection element in its position.

As the assembly is relatively long, the bars 18, 20, 22 and 24 are provided with slits 60 adapted to insert support parts 54 made of metal or a transparent material. This is shown in greater detail in the cross sectional view of FIG. 2 and in the detailed view of FIG. 6.

The bars 18, 20, 22 and 24 are provided with circular projections 56 extending in the direction of the lighting means 40. The projections 56 have a center bore 58. Slits 60 along the bar 18 serve to receive the support parts 54. The support parts 54 are plane and extend in the plane perpendicular to the connection bars. They have four ends 62, 64, 66 and 68 extending in the direction of the connection bars. Each of the ends is provided with a bore hole corresponding to the bore hole 58 of the connection bar 18 in an assembled state. A wire or a tube inserted through these bore holes keeps the support parts and the connection bars together. As long as the end caps are not put in place the support parts 54 are rotatably fitted about axes 55. This facilitates the assembling.

Figure 6:
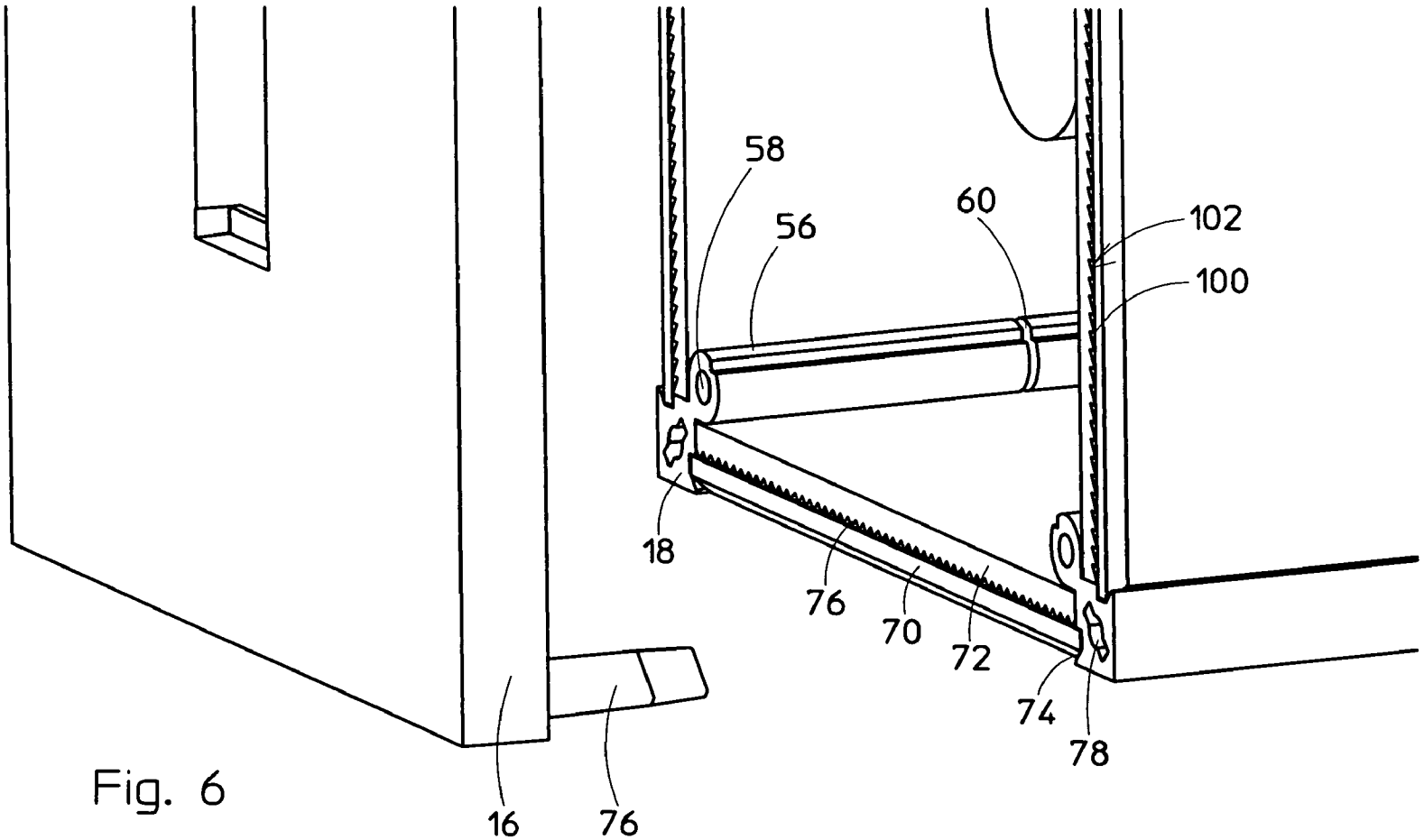
FIG. 6 shows a detail of the lighting assembly of FIG. 1.

The covers 70 and the micro prism plate 72 are chamfered at their outer edges 74. This is shown in FIG. 6. The connection bars and the end portions 14 and 16 have a corresponding profile. This facetted cut is designed especially at the end portions in such a way that tolerances due to the different expansion coefficients of the materials is compensated. It is considered that the end pieces must have larger tolerances in this direction due to the larger expansion. The facetted cut all around enables the form-fitted engagement between the plates and the cast elements (end portions) or the bars and end portions, respectively.

The covers are maintained in their position by the profiles. The lateral openings of the housings and the bottom opening of the housing are covered in this way by glass sheets 70. Micro prism plates 72 are arranged on the inside of the glass sheets 70. The micro prism plates 72 are formpressed acrylic. They are provided with a plurality of micro prisms outwardly projecting towards the glass sheet 70. The glass sheet protects the respective projections to avoid damaging or contamination.

Figure 9:
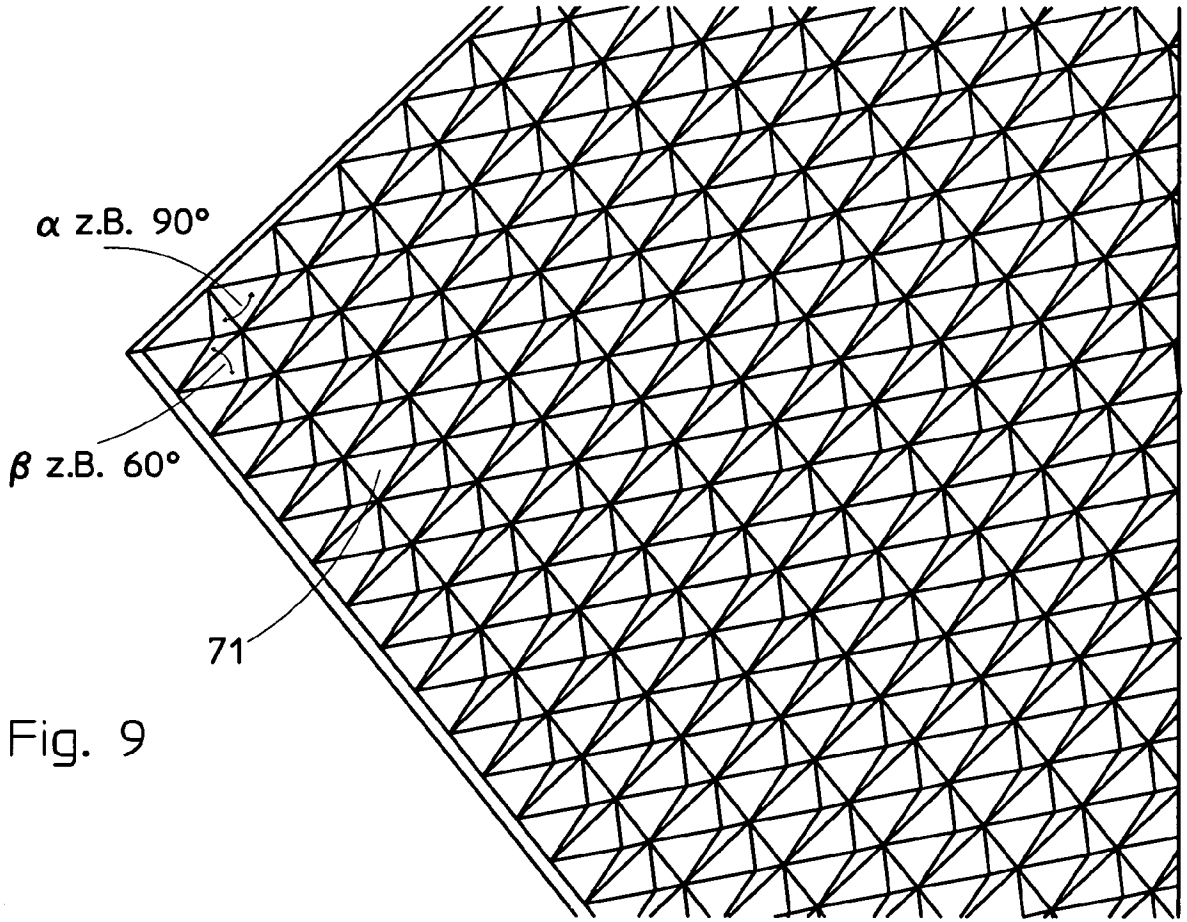
FIG. 9 is an enlarged perspective representation of a micro prism plate.

In FIG. 9 a portion of such a micro prism plate 72 is shown in greater detail. The micro prisms 71 of the present embodiment consist of pyramid-shaped projections arranged directly next to each other. The deflection of a light beam is determined, amongst others, by the inclination angles $\alpha$ and $\beta$ of the prism surfaces. It has been found that a ratio of the height of the micro prisms relatively to the overall height of the structure of 1:3 can be particularly easily manufactured. The micro prisms are less than 2 mm and are produced with high quality by form-pressing.

Figure 10:
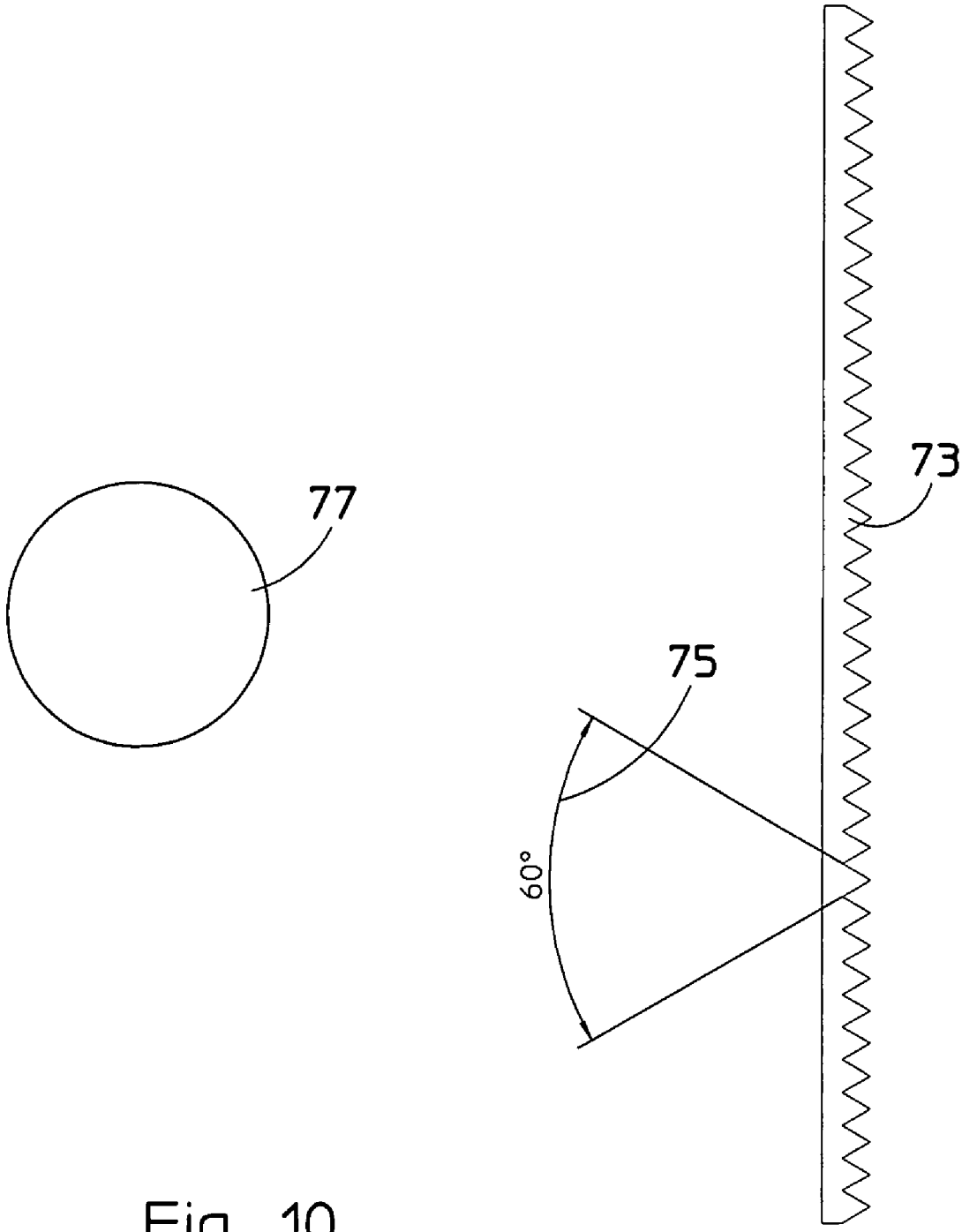
FIG. 10 is a cross section of a micro prism plate with prisms having the same size.
Figure 11:
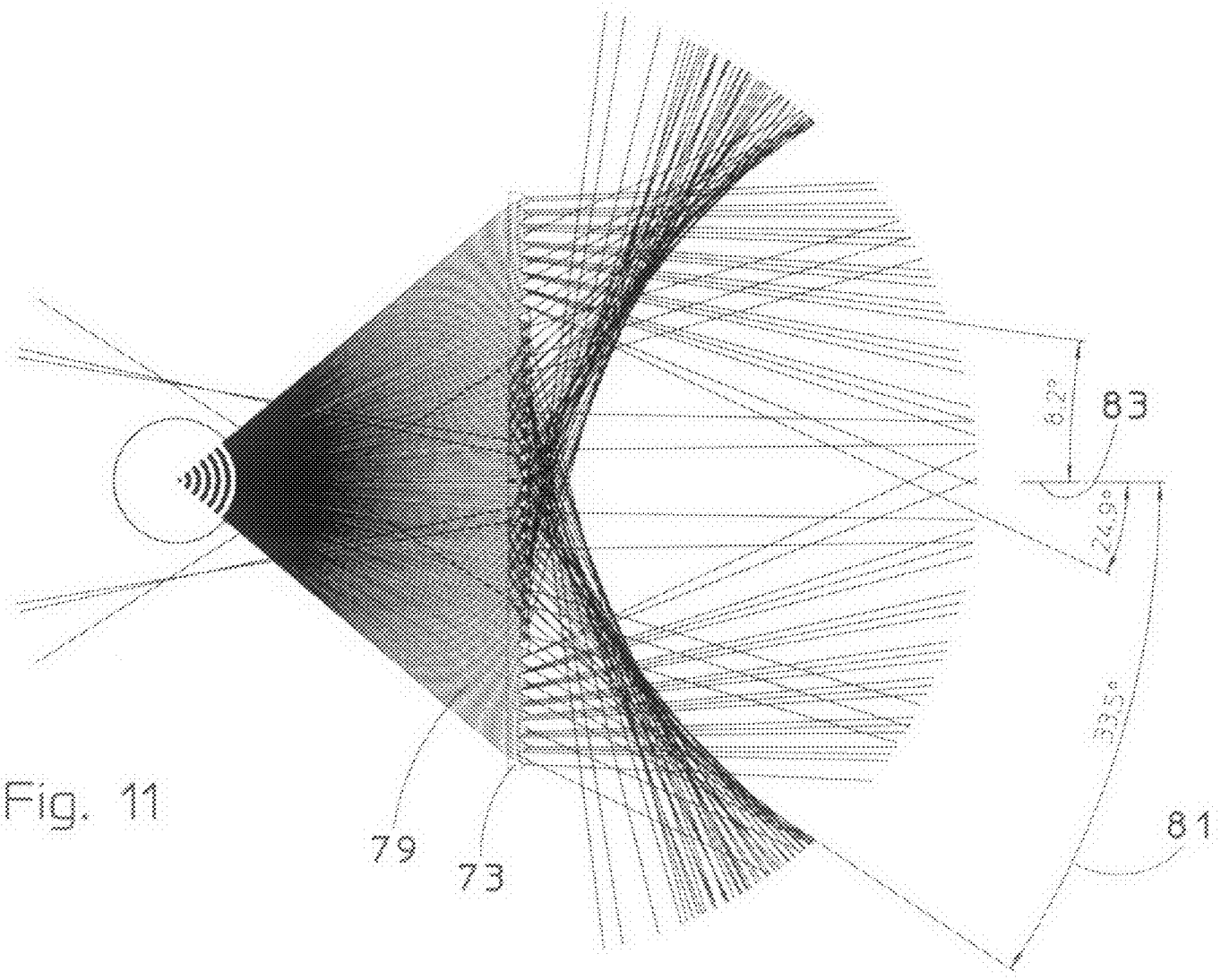
FIG. 11 shows the path of rays in an assembly according to FIG. 10.

The effect of different angles at a lateral micro prism plate is shown in FIGS. 10 to 15. In FIG. 10 a portion of a micro prism plate 73 is shown. The prisms have an opening angle 75 of 60°. FIG. 10 also schematically shows a lighting means 77. In FIG. 11 the path of rays 79 is shown. The light rays 79 are deflected at the micro prism plate 73 of FIG. 10. It can be seen that in the shown configuration only very little radiation is emitted within the observation angle 81 of 33.5° regarding the horizontal line 83, while the main portion of the radiation is concentrated downwardly and upwardly in much inclined angular ranges. In such a way, blinding of an observer in distant areas is avoided. However, the spatial range below the light, for example a work place, is well illuminated. The reception, therefore, varies with the position of the observer with such a lighting assembly. The observer entering into a room sees only very little of the light and is not blinded. If the observer approaches the lamp he will be more and more illuminated.

Figure 12:
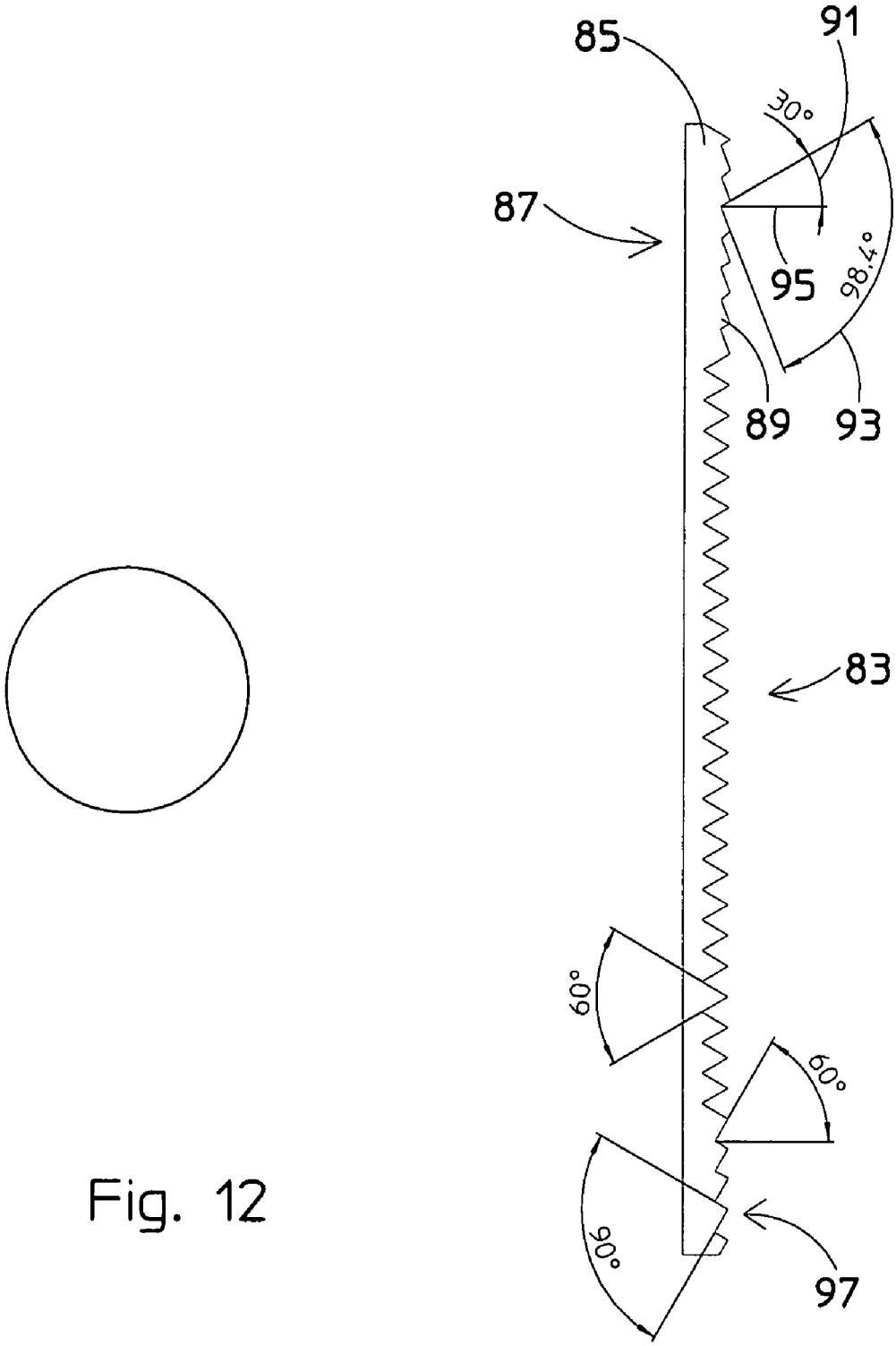
FIG. 12 is a cross sectional view of a micro prism plate with prisms having different prism angles in different ranges.
Figure 13:
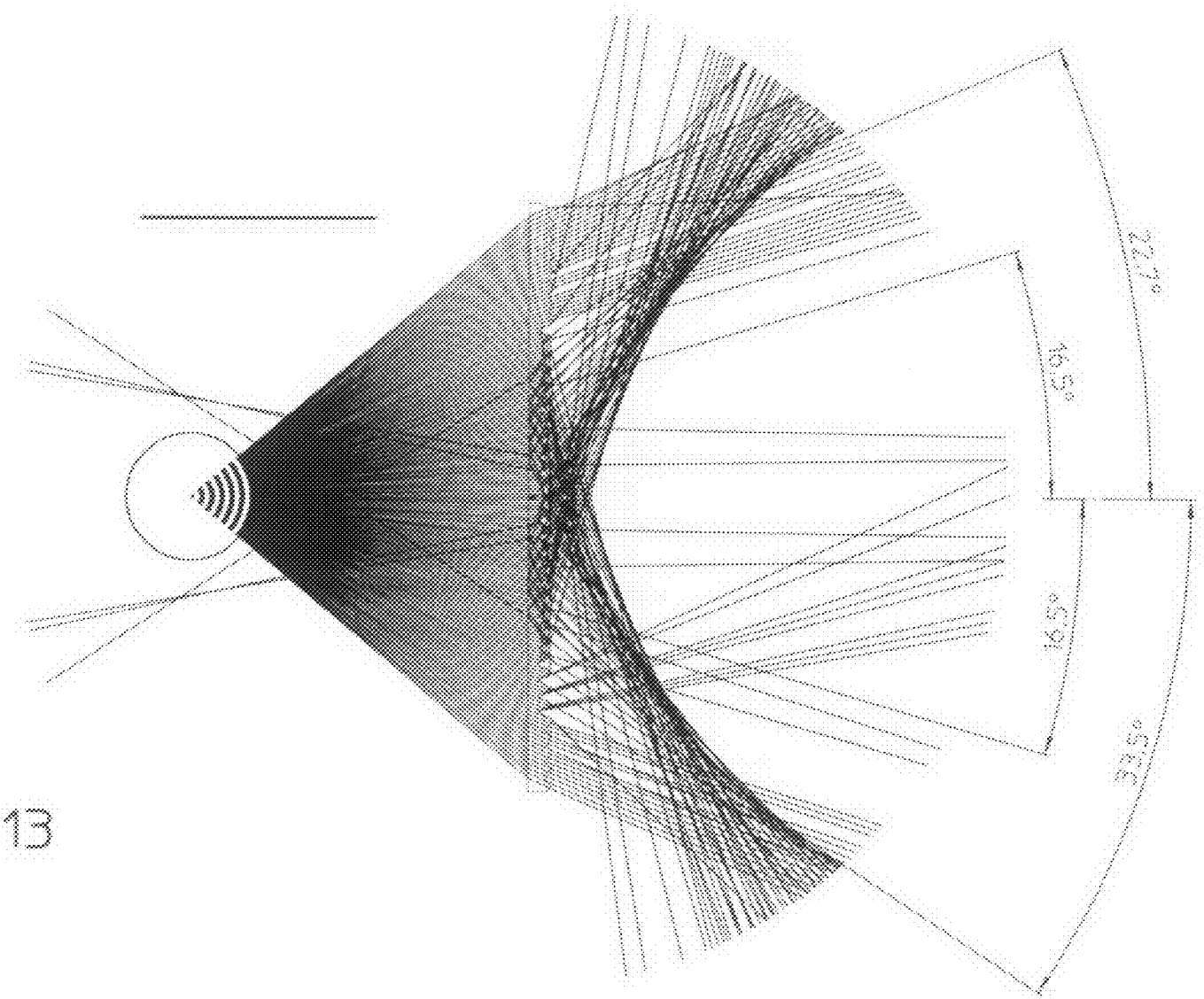
FIG. 13 shows the path of rays in an assembly according to FIG. 12.

In FIGS. 12 and 13 an assembly is shown where the prism angle varies along the height of the lighting assembly. As in the embodiment according to FIGS. 10 and 11, a prism angle of 60° is provided in the center range 83 of the micro prism plate 85. The prisms 89 are non-symmetrical in the upper range 87. Starting with a large angle 93 of 98.4° the angle 91 is upwardly only 30° relative to the horizontal line 95. In the lower range 97 the distribution of the non-symmetrical prisms is 60° and 90°. The corresponding path of rays is illustrated in FIG. 13. It can be seen that the central range is completely shielded in the horizontal direction and practically no radiation is emitted in this angular range.

Figure 14:
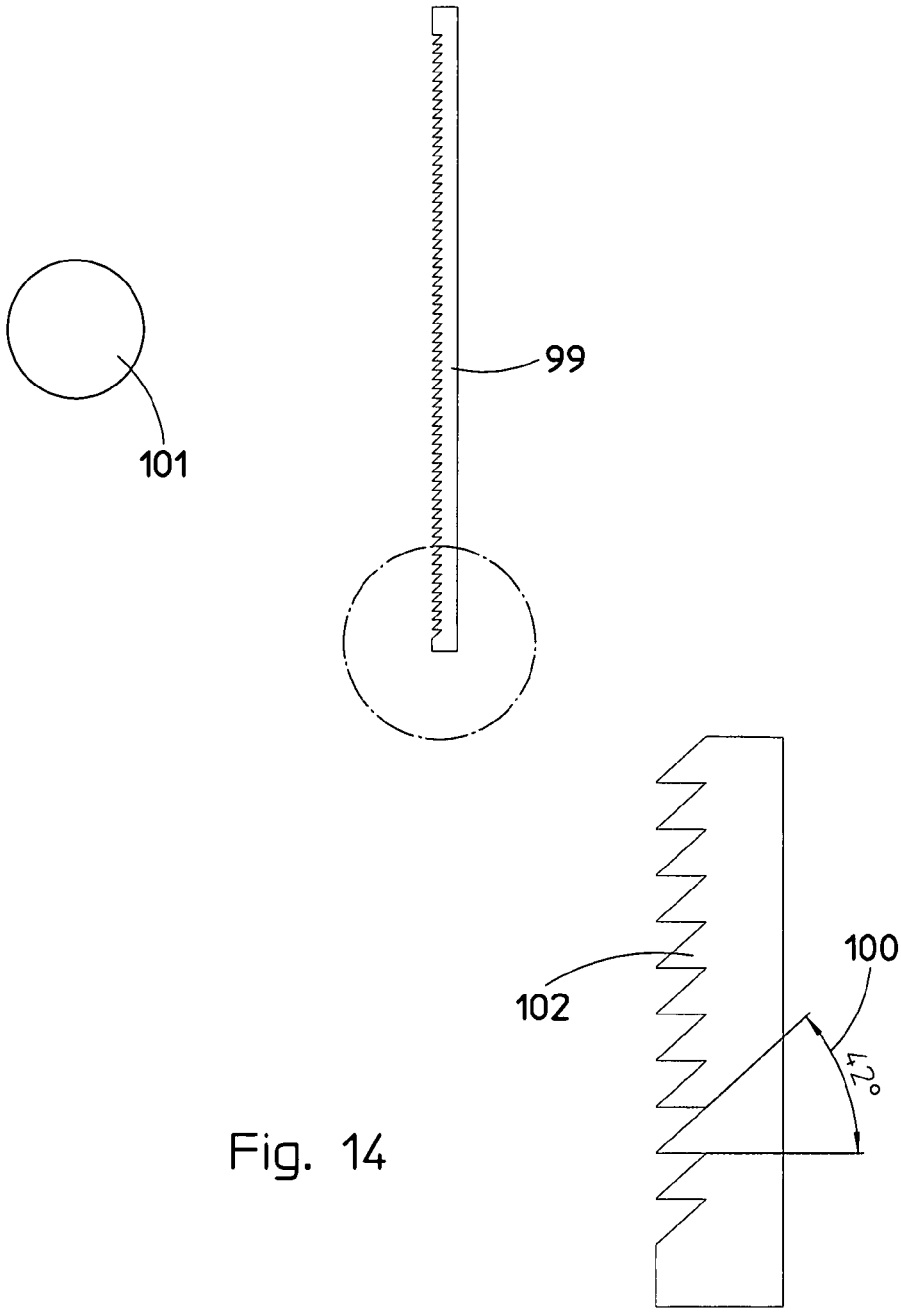
FIG. 14 is a cross sectional view of a micro prism plate with prisms projecting towards the inside.
Figure 15:
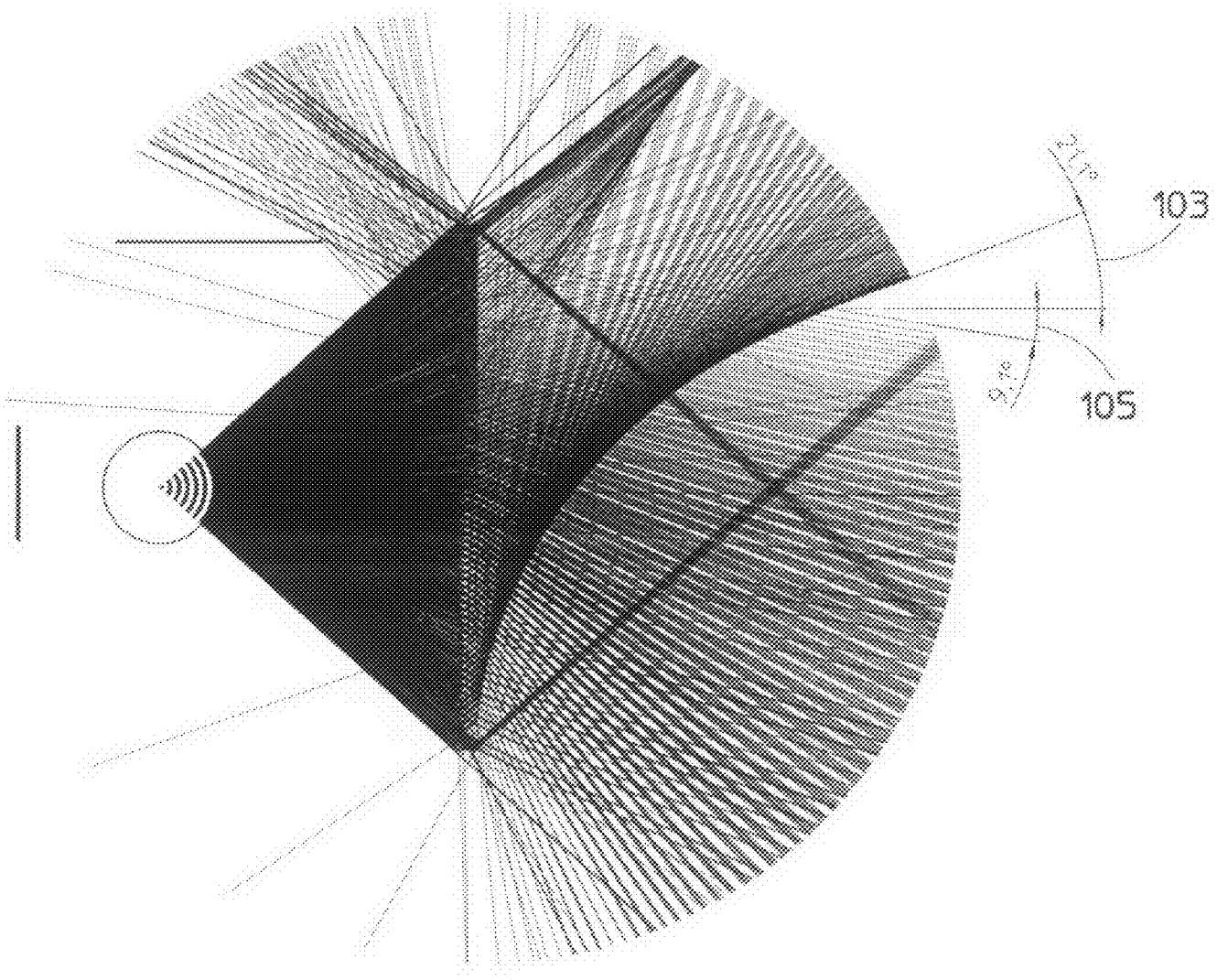
FIG. 15 shows the path of rays in an assembly according to FIG. 14.

FIG. 14 shows a micro prism plate 99 with non-symmetrical prisms. These are, however, inwardly directed in the direction of the lighting means 101 as opposed to the micro prism plates according to FIGS. 10 to 13. In such an assembly, a distribution is achieved which is illustrated in FIG. 15. Here are also ranges 103, 105 which are shielded.

The connection bars 18, 20, 22 and 24 are each provided with an opening 78 in a longitudinal direction on their ends. Corresponding projections 76 on the inside of the end portions 14 and 16 are inserted into these openings. This can be best seen in FIGS. 6 and 7.

The upper cover lays on the housing. In order to accommodate the fluorescent lamp, the support parts 66 are upwardly open, as it is shown in FIG. 2. The form of the support parts can be adapted to any desired cross sectional shape. It is principally variable allowing any given shape of a housing.

In FIG. 1 a first possibility of a modular construction is shown. A connection element 50 is inserted into the slit 46 of the end portion 14 with a projection 48 as it is described above. The connection element 50 is provided with a bore hole 80 adapted to insert a tube 52 (see FIG. 1). The tube 52 is used to fix the light to the ceiling.

Figure 8:
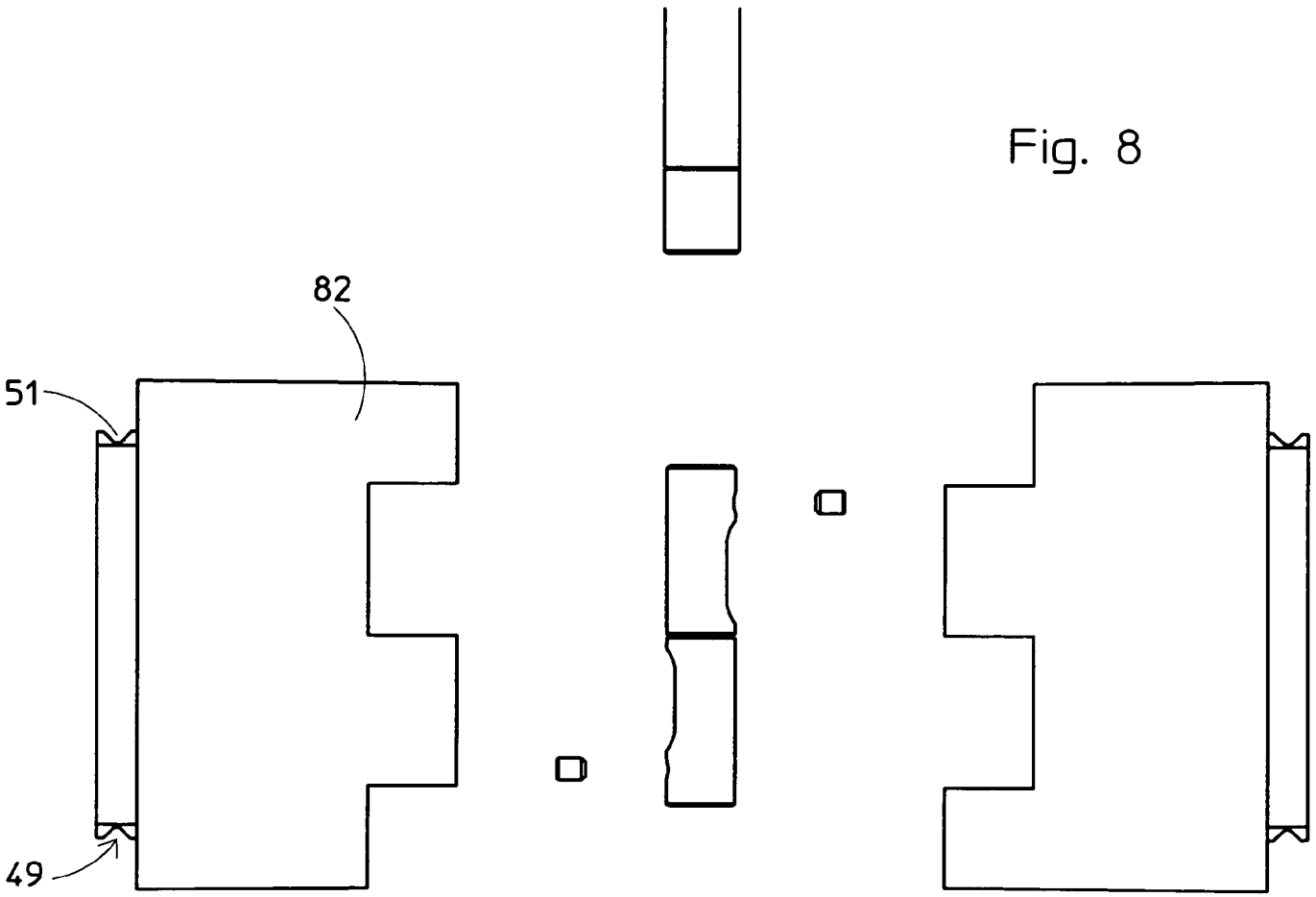
FIG. 8 is a cross section through two connection portions.
Figure 16:
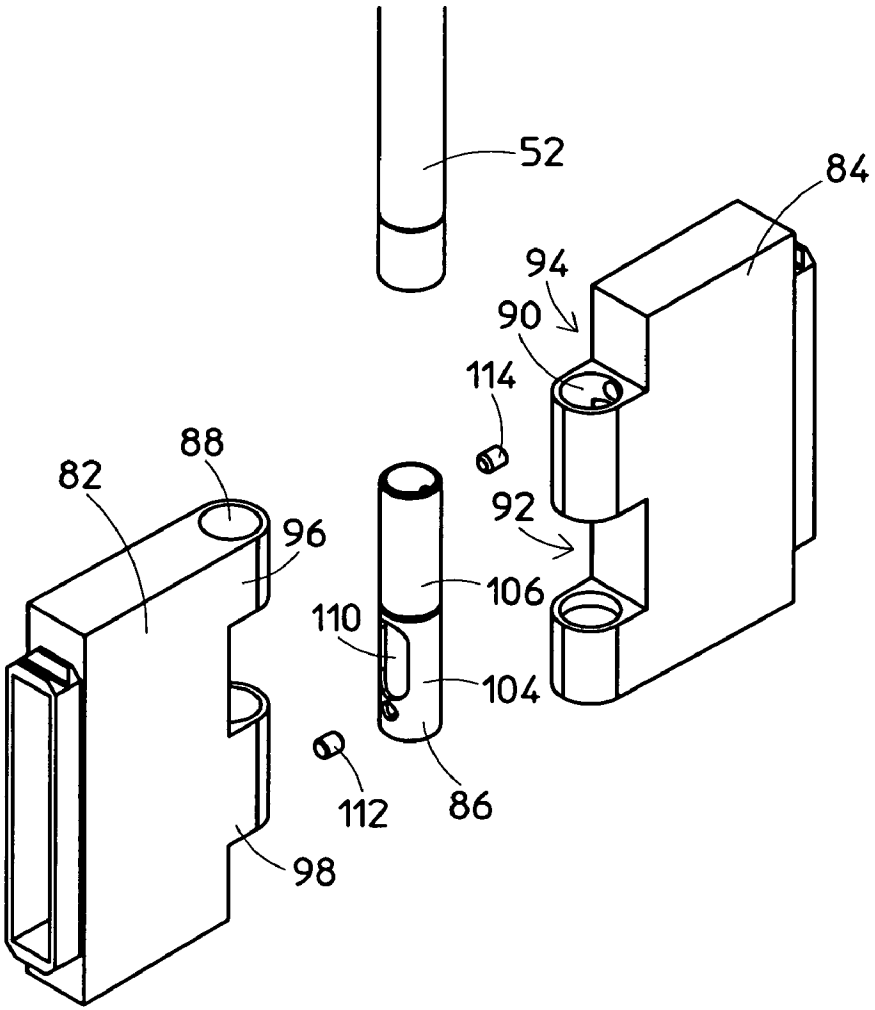
FIG. 16 illustrates a joint with two lighting elements in an exploded view.
Figure 17:
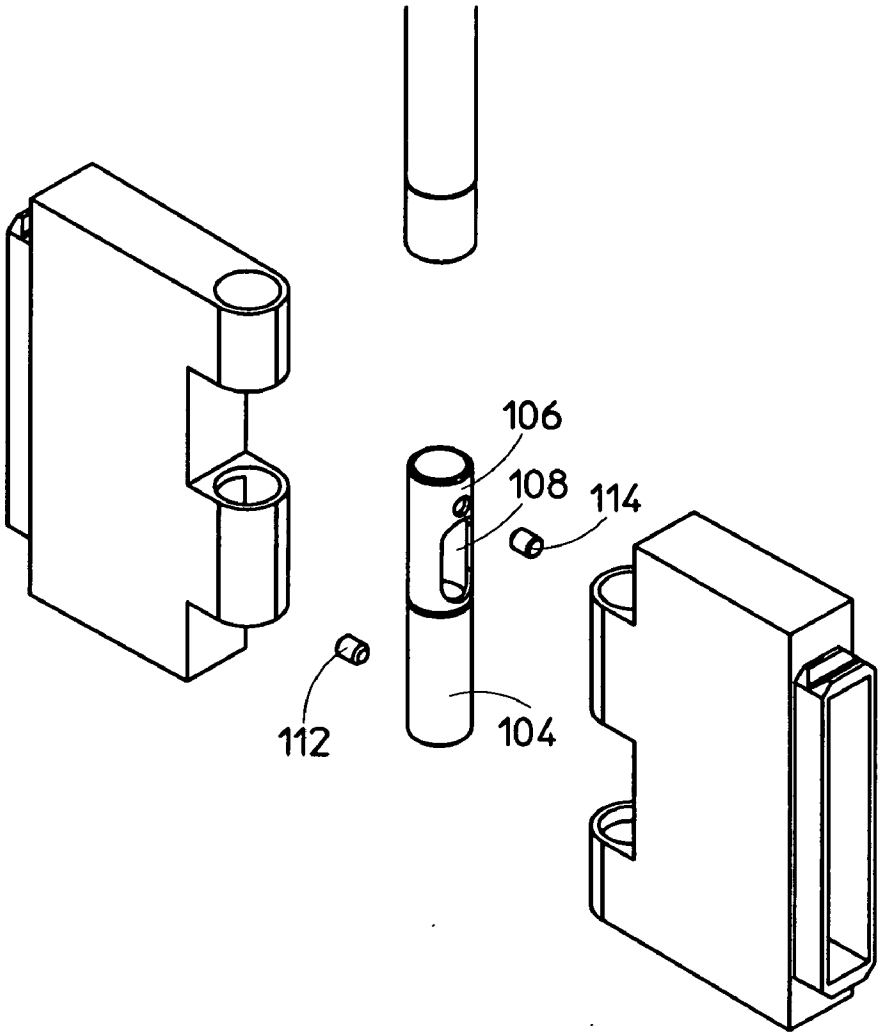
FIG. 17 illustrates the joint of FIG. 16 from a different perspective.
Figure 18:
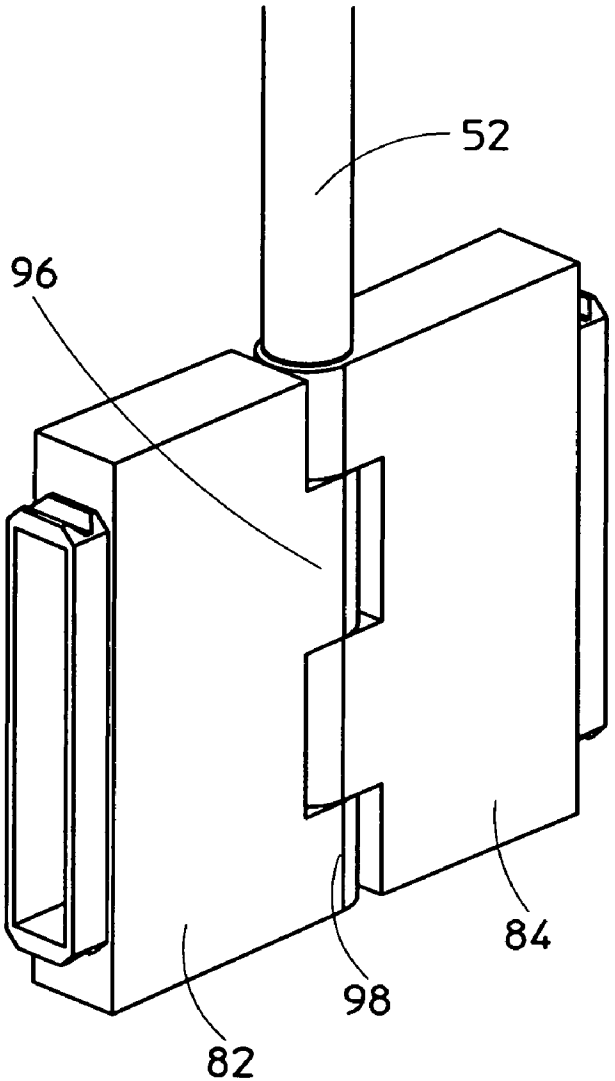
FIG. 18 illustrates a joint for a plurality of lighting means according to FIG. 16 in an assembled state.

In FIG. 8 and in FIGS. 16 to 18 an alternative possibility of a modular construction is shown. Instead of only one connection element two connection elements 82 and 84 of different lighting elements (not shown) are fixed to the same tube 52. For this purpose, the tube 52 is inserted into a two-portion sleeve 86. The sleeve extends through bore holes 88 and 90 in the connection elements 82 and 84. The connection elements 82 and 84 each are provided with two recesses 92 and 94 engaging the thereby projecting portions 96 and 98 of the respective corresponding connection element. This is shown in FIG. 18.

The sleeve portions 104 and 106 of the sleeve 86 are each provided with openings 108 or 110, respectively (FIG. 17, FIG. 18). A pin 112 or 114, respectively, is provided below the opening 110 and above the opening 108. Each sleeve portion 104 and 106 is fixed with this pin in its position relative to the connection elements 82 and 84, respectively. The sleeve portions 104 and 106 are pivotably connected. Thereby the opening 110 is always directed towards the connection element 82. The opening 108 is always directed towards the connection element 84. Both connection elements are pivotably connected and the openings are always correctly directed. The connection cable for the lighting assembly is lead through the hollow space in the tube 52, the sleeve 86 and the openings. It is electrically connected with a three-portion socket 116. The socket 116 is shown in detail in FIG. 19. The cover with the fluorescent lamp has corresponding plugs 118. The electrical contact is easily established by simply plugging in the cover. The sockets of the lighting means are provided in the cover provided between two connection bars. Thereby the socket is not disposed at the end portions.

In an assembly where the connection element is not connected to further connection elements, the cable can be lead directly through the connection element to the socket 116.

In a similar way, linear, crossed, or angular lighting assemblies can be generated with the different connection elements.

The desired illumination profiles can be generated with the described lighting assembly. Especially certain angular ranges can be shielded and the light can be diverted to different ranges. For this purpose the opening angle 100 of the micro prisms 102 are variable along the height of the opening. The opening angles are selected such that the angular range in which the light is visible is shielded. The radiation is deflected in such a way that it is emitted in different angular ranges.

The glass sheets or the backside of the profiled plates can be engraved with letters or can be imprinted with screen print. The lighting assembly is also suitable to be fixed to the wall. In this case tubes 52 and sometimes the connection elements are not necessary.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

What is claimed is:

1. A lighting assembly (10) comprising a housing (12), said housing having one or more openings (26, 28, 30), one of said openings facing a downward direction;

wherein said housing has side walls and a bottom and said openings of said housing extend along a major portion of said side walls and of said bottom, and one or more frame portions (18, 20, 22, 24) are provided;

a lighting means (40) arranged in said housing, said lighting means emitting radiation through said openings (26, 28, 30) in angular ranges; and means (72) for shielding said radiation;

and further comprising a first transparent cover (32; 72) for covering said opening facing a downward direction of said housing, said cover being a plate having a micro structure profile (102) to shield said radiation from selected portions of said angular ranges, and a second transparent cover in the form of a plate (70) to protect said micro structure profile, said frame portions holding said first and second covers against one another.

2. A lighting assembly according to claim 1, wherein said housing has a rectangular cross section, said side walls and said bottom form said openings of said housing, and said first and second transparent covers (70, 72) are flat, transparent sheets.

3. A lighting assembly according to claim 2, wherein said first transparent covers (72) for covering said openings of said housing are provided with a profile consisting of outwardly projecting prisms or linear lamellae having an opening angle (100) and said opening extends along a height in a vertical direction, and wherein said opening angle (100) of said prisms or linear lamellae changes along said height of said openings.

4. A lighting assembly according to claim 1, wherein said first transparent covers (72) are made of pressed acrylic or glass.

5. A lighting assembly according to claim 1, wherein said first and second transparent covers (72, 70) consist of a fire-resistant plastic material.

6. A lighting assembly according to claim 5, wherein said fire-resistant plastic material is polycarbonate.

7. A lighting assembly according to claim 1, wherein said micro structure profiles comprise micro prism structures (102).

8. A lighting assembly according to claim 1, wherein said housing comprises two end portions (14, 16) and frame portions (18, 20, 22, 24) are provided to connect said end portions in a position, and wherein plane support parts (54) positioned parallel to said end portions are additionally provided to keep said frame portions in said position.

9. A lighting assembly according to claim 8, wherein said end portions (14, 16) are provided with an opening (46) adapted to have connection elements (50) locked in.

10. A lighting assembly according to claim 9, wherein said connection elements (82, 84) are pivotably connected to each other and/or are adapted to be connected with fixing devices (52).

11. A lighting assembly according to claim 1, wherein a plurality of lighting means with different wavelength spectra with different spectral radiation intensity are provided, and including control means to adjust said radiation intensity of said individual lighting means.

12. A lighting assembly (10) comprising a housing (12), said housing having one or more openings (26, 28, 30), two end portions (14, 16), frame portions (18, 20, 22, 24) to connect said end portions in a position, and plane support parts (54) positioned parallel to said end portions to keep said frame portions in said position;

a lighting means (40) arranged in said housing, said lighting means emitting radiation through said openings (26, 28, 30) in angular ranges; and means (72) for shielding said radiation;

and further comprising a first transparent cover (32; 72) for covering said openings of said housing, said cover having a micro structure profile (102) to shield said radiation from selected portions of said angular ranges, and a second transparent cover (70) to protect said micro structure profile.

13. A lighting assembly according to claim 12, wherein said end portions (14, 16) are provided with an opening (46) adapted to have connection elements (50) locked in.

14. A lighting assembly according to claim 13, wherein said connection elements (82, 84) are pivotably connected to each other and/or are adapted to be connected with fixing devices (52).

* * * * *